US007677481B2

(12) United States Patent
Buquet et al.

(10) Patent No.: US 7,677,481 B2
(45) Date of Patent: Mar. 16, 2010

(54) DEVICE FOR ELECTROSTATICALLY PROJECTING A COATING MATERIAL AND A METHOD FOR CONTROLLING POWER SUPPLY TO VOLTAGE INCREASING OF SAID DEVICE

(75) Inventors: Thierry Buquet, Allevard (FR); Michel Di Gioia, Seyssinet Pariset (FR)

(73) Assignee: Sames Technologies, Meylan (FR)

( * ) Notice: Subject to any disclaimer, the term of this patent is extended or adjusted under 35 U.S.C. 154(b) by 81 days.

(21) Appl. No.: 11/910,726

(22) PCT Filed: Mar. 31, 2006

(86) PCT No.: PCT/FR2006/000717

§ 371 (c)(1),
(2), (4) Date: Oct. 4, 2007

(87) PCT Pub. No.: WO2006/106216

PCT Pub. Date: Dec. 10, 2006

(65) Prior Publication Data

US 2008/0111000 A1 May 15, 2008

(30) Foreign Application Priority Data

Apr. 4, 2005 (FR) ..... 05 03295

(51) Int. Cl.

| | |
|---|---|
| ***B05B 5/03*** | (2006.01) |
| ***B05B 5/053*** | (2006.01) |
| ***B05B 5/025*** | (2006.01) |
| ***B05C 11/00*** | (2006.01) |

(52) U.S. Cl. ..... 239/691; 239/3; 239/71; 239/526; 239/704; 239/707; 118/629; 118/712

(58) Field of Classification Search ..... 239/67, 239/71, 526, 690, 691, 704–708, 3, 452; 361/225–228; 118/620–640, 692, 712, 713; 427/458, 475

See application file for complete search history.

(56) References Cited

U.S. PATENT DOCUMENTS

| | | | | |
|---|---|---|---|---|
| 5,351,520 | A | 10/1994 | Buquet et al. | |
| 5,765,761 | A * | 6/1998 | Law et al. | 239/690.1 |
| 6,467,705 | B2 * | 10/2002 | Robidoux | 239/697 |
| 2003/0160105 | A1 | 8/2003 | Kelly | |

FOREIGN PATENT DOCUMENTS

| | | |
|---|---|---|
| GB | 2100147 | 12/1982 |

* cited by examiner

*Primary Examiner*—Darren W Gorman
(74) *Attorney, Agent, or Firm*—Robert M. Gould; Duane Morris LLP

(57) ABSTRACT

The inventive device for electrostatically projecting a coating product comprises a spray gun provided with voltage increasing means for producing a high direct voltage for a product electrostatic charge, wherein said spray gun is provided with a controllable valve for controlling an atomizing air flow inside the spray gun in the direction to a spraying head. A pressure sensor integrated into the spray gun is used for detecting the atomizing air pressure (P) representative value downstream of the valve and for delivering a signal (S1) for controlling the power supply of the voltage increasing means. Said invention makes it possible to control the power supply of the voltage increasing means according, in particular, to the signal (S1) received from the sensor.

12 Claims, 3 Drawing Sheets

DEVICE FOR ELECTROSTATICALLY PROJECTING A COATING MATERIAL AND A METHOD FOR CONTROLLING POWER SUPPLY TO VOLTAGE INCREASING OF SAID DEVICE

The invention relates to an installation for electrostatically spraying a coating material, and to a method of controlling the supply of electricity to voltage-multiplier means within such an installation.

In the field of spraying coating materials by means of an electrostatic sprayer, it is known to install an air flow detector device, sometimes referred to as a "flow-contact" in the line for feeding atomization air to the sprayer, which device is usually located outside the spray cabin, i.e. outside the atmosphere considered as being explosive, in the vicinity of a module for electrically powering the high voltage cascade integrated in the sprayer. Such a flow-contact generally comprises a float that is moved by the flow of air, with such movement being detected by an appropriate sensor. Such a flow-contact is expensive, and is found in practice to be relatively unreliable because of the presence of moving parts, such as the float. In addition, the flow-contact, when installed at a distance from the sprayer, cannot take account of any leaks or obstructions that might involve the air flow line downstream.

It is also known from U.S. Pat. No. 4,441,656 to control a voltage multiplier circuit by the position of the end of a trigger actuated by a painter. Such an approach makes it possible to ensure that the electrostatic field is generated only when the trigger is actuated. The sprayer in question is of the "airless" type, i.e. it is fed with coating material under pressure without using atomization air. That equipment does not enable account to be taken of any failures in the air feed to a sprayer in which atomization air is used. In addition, that known equipment is bulky, heavy, and expensive.

The invention seeks most particularly to remedy those drawbacks by proposing an installation for electrostatically spraying a coating material, in which the operation of the installation is made safer than in known equipments.

In this spirit, the invention relates to an installation for electrostatically spraying a coating material, the installation comprising a sprayer provided with voltage-multiplier means suitable for generating a direct high voltage for electrostatically charging said material, said sprayer being fitted with a controlled valve controlling the flow of atomization air inside said sprayer towards a spray head. This installation is characterized in that a pressure sensor integrated in said sprayer is suitable for detecting a value representative of the pressure of atomization air downstream from said valve and for delivering a signal suitable for use in controlling the supply of electricity to said voltage-multiplier means.

By means of the invention, the voltage-multiplier means can be activated as a function of detecting an atomization air pressure value that corresponds to an actual flow downstream from the controlled valve. Thus, a leak in the atomization air feed line can prevent the voltage-multiplier means from being activated, unlike what can happen in an installation provided with a flow-contact, where untimely activation of the voltage-multiplier means can create an electrostatic field that is essentially dangerous.

According to aspects of the invention that are advantageous but not essential, such an installation may incorporate one or more of the following characteristics taken in any technically-feasible combination:

A distinct module of the sprayer is provided for supplying electricity to the voltage-multiplier means, and the above-mentioned signal is transmitted to said module that controls the electricity supply to the voltage-multiplier means as a function of the signal. The electricity supply module is advantageously provided with a display for displaying the pressure value detected by the sensor, where monitoring this pressure makes it possible to govern the process of applying the coating material. Provision may also be made for the signal from the sensor to be transmitted to the above-mentioned module via the line for supplying electricity from said module to the voltage-multiplier means. In a variant, the signal from the sensor may be sent to the module over a wireless connection.

The means for making use of the signal issued by the sensor are suitable for correcting drift of the sensor relative to atmospheric pressure.

The sprayer is hand-held, and the valve is controlled by a trigger designed to be actuated by an operator.

The sensor is suitable for detecting an abnormal rise in pressure inside the sprayer away from the path along which the atomization air flows, and for delivering a corresponding signal to the processor means.

The invention also relates to a method of controlling the supply of electricity to voltage-multiplier means, which method is suitable for being implemented in an installation as mentioned above, and more specifically, the invention relates to a method comprising the steps consisting in:

a) detecting, downstream from a controlled valve for controlling the flow of atomization air inside said sprayer, a value that is representative of the pressure of the atomization air; and b) controlling the supply of electricity to said voltage-multiplier means as a function, in particular, of a signal representative of the value that is detected.

Because of the method of the invention, the supply of electricity to the voltage-multiplier means is controlled while taking account of whether atomization air is actually flowing inside the sprayer.

Advantageously, the voltage-multiplier means are supplied with electricity from a module that is distinct from said sprayer, so long as said signal is supplied to said module. Provision can also be made, after each closure of the valve, for the sensor used for detecting the pressure value to be reinitialized while taking account of the signal at atmospheric pressure, thus making it possible to avoid drift in the detected value, e.g. drift as a function of temperature. After each closure of the valve, the sensor can also be used for detecting any leak inside the sprayer.

The invention can be better understood and other advantages thereof appear more clearly in the light of the following description of an embodiment of an installation in accordance with the principle of the invention and of a control method implemented in the installation, given purely by way of example and made with reference to the accompanying figures, in which.

Figure 1:
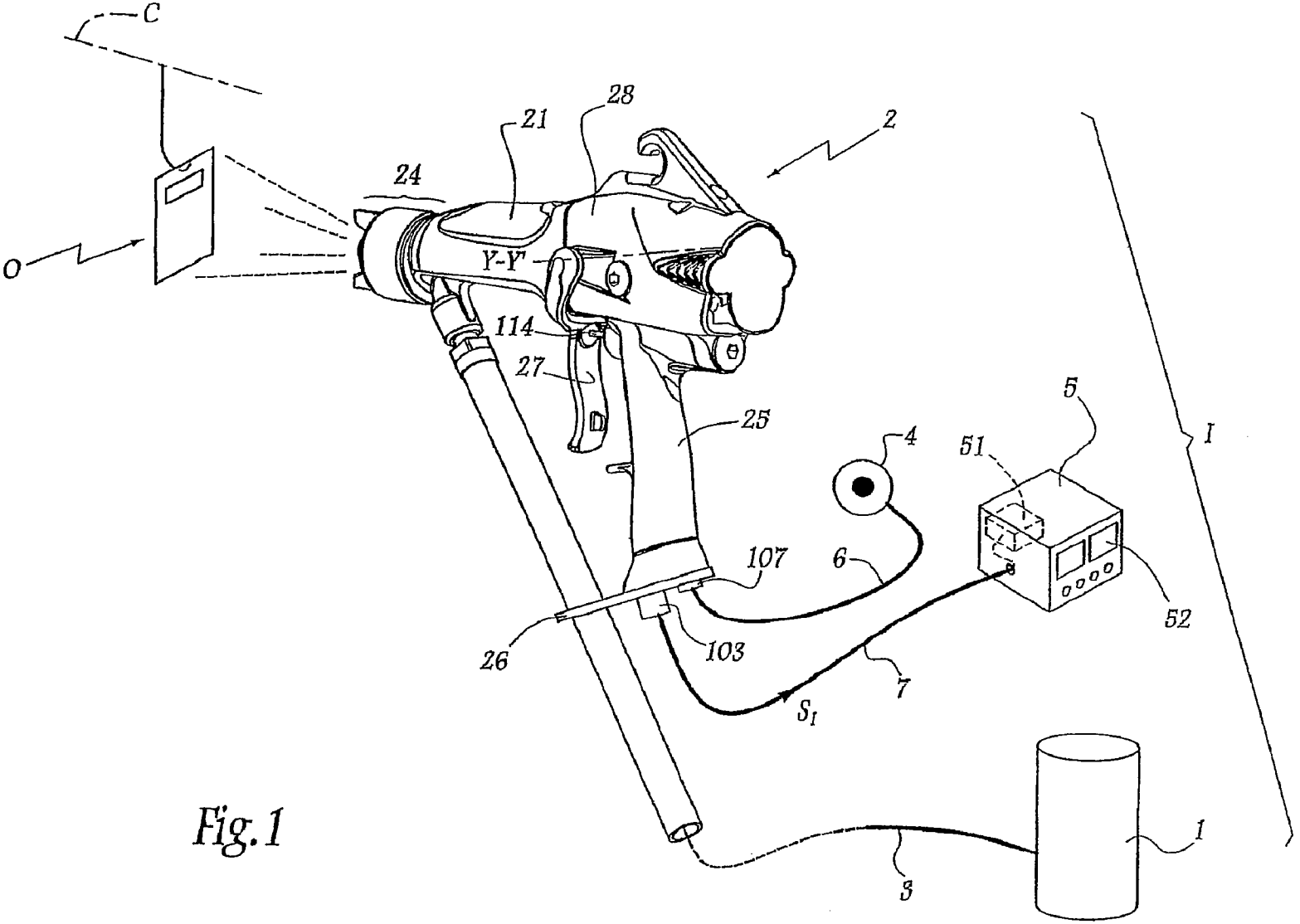
FIG. 1 is a diagrammatic perspective view of an installation in accordance with the invention.

The installation I shown in FIG. 1 is for electrostatically coating an article O being moved by a conveyor C.

The installation I includes a tank 1 of coating material for spraying, together with a hand-held sprayer or spray gun 2 for electrostatic coating that is fed with material from the tank 1 via a hose 3.

The spray gun 2 is also connected to a source 4 of air under pressure and to a control module 5 delivering electricity to the spray gun 2 for operating a high-voltage cascade 101 disposed in the barrel 21 of the spray gun 2. Air coming from the source 4 is used for atomizing the material and for entraining it from the spray gun 2 towards the articles O.

Reference 6 designates the hose feeding the spray gun from the source 4, and reference 7 designates the cable connecting the module 5 to the spray gun 2. The module 5 is itself supplied with electricity from the mains, by means of a cable that is not shown.

Figure 2:
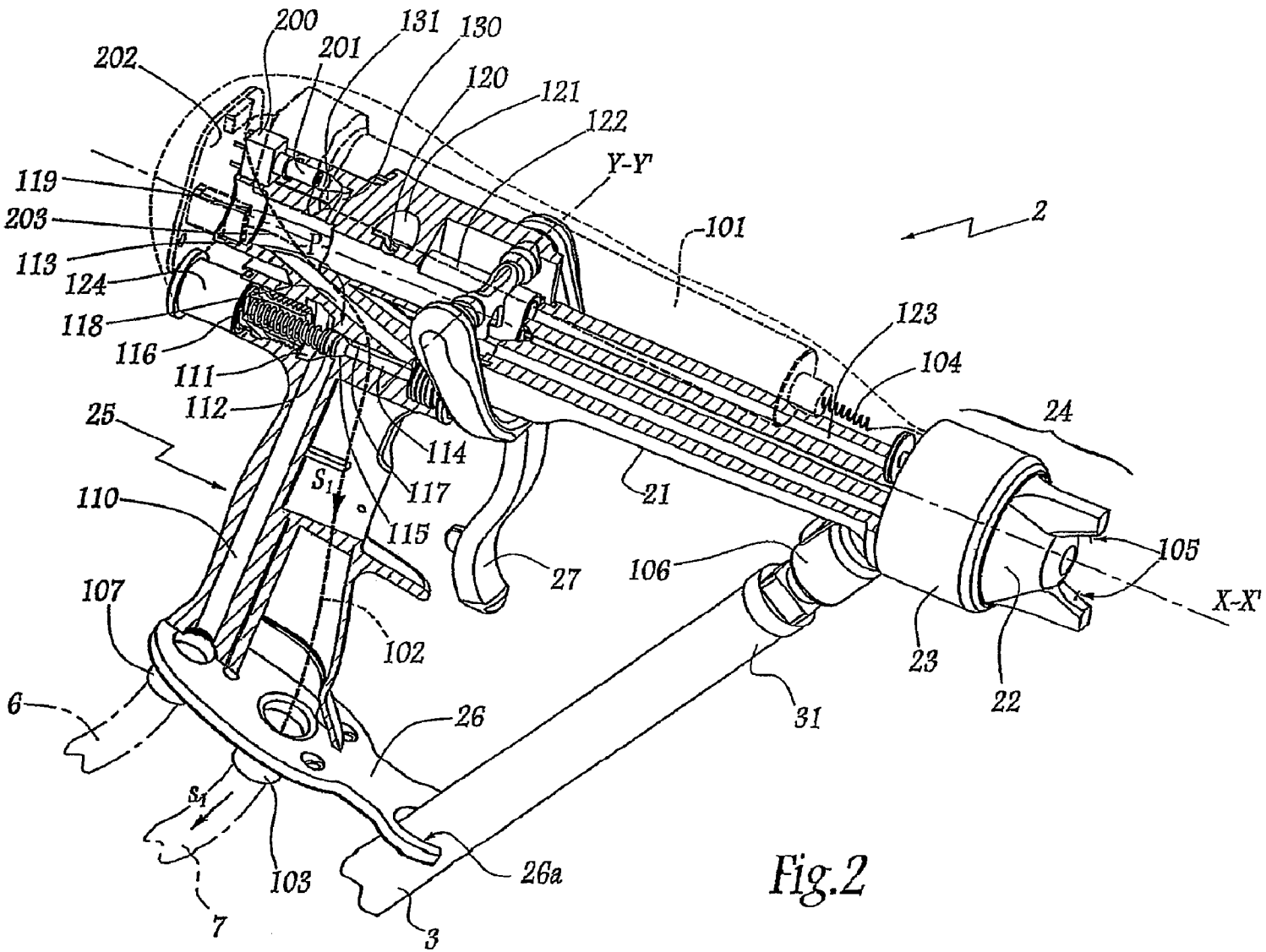
FIG. 2 is a fragmentary, cutaway perspective view of the sprayer of the FIG. 1 installation.

A cable 102 represented in FIG. 2 by a dashed line following its path serves to connect a coupling connector 103 of the cable 7 to the cascade 101. The cascade 101 is thus powered from the module 5. It generates a direct high voltage that is transmitted by an electrical conductor 104 to two electrodes 105, and that serves to charge the coating material sprayed from a spray nozzle 22 mounted by means of a ring 23 at the spray head 24 of the gun 2. In a variant, it is possible to use only one electrode or to use more than two electrodes.

The downstream end 31 of the duct 3 is received in a coupling bushing 106 disposed close to the spray head 24.

In known manner, the grip 25 of the spray gun 2 is provided with a plate 26 having the connector 103 fitted thereto, together with a connector 107 for coupling to the hose 6, the plate 26 defining a housing **26*a* for receiving and holding the hose 3. In a variant of the invention that is not shown, a coupling connected to ground may also be provided for the hose 3 at the plate 26**.

A trigger 27 is hinged to the body 28 of the spray gun 2 about an axis Y-Y' that is generally perpendicular to the longitudinal axis X-X' of the barrel 21.

A duct 110 extends inside the grip 25 from the connector 107 to a chamber 111 surrounding the needle 112 of a valve 113 having a rod 114 designed to have the trigger 27 bear thereagainst.

The needle 112 is of a shape adapted to bear against a seat 115 of corresponding shape under drive from a return force exerted by a spring 116 held in position by a plug 124 constituting a fixed bearing point for the spring. Another plug 125 serves to isolate the duct 117 and the valve 113 from the surrounding atmosphere beside the trigger 27. By default, the valve 113 is closed under the effect of the return force from the spring 116.

Figure 3:
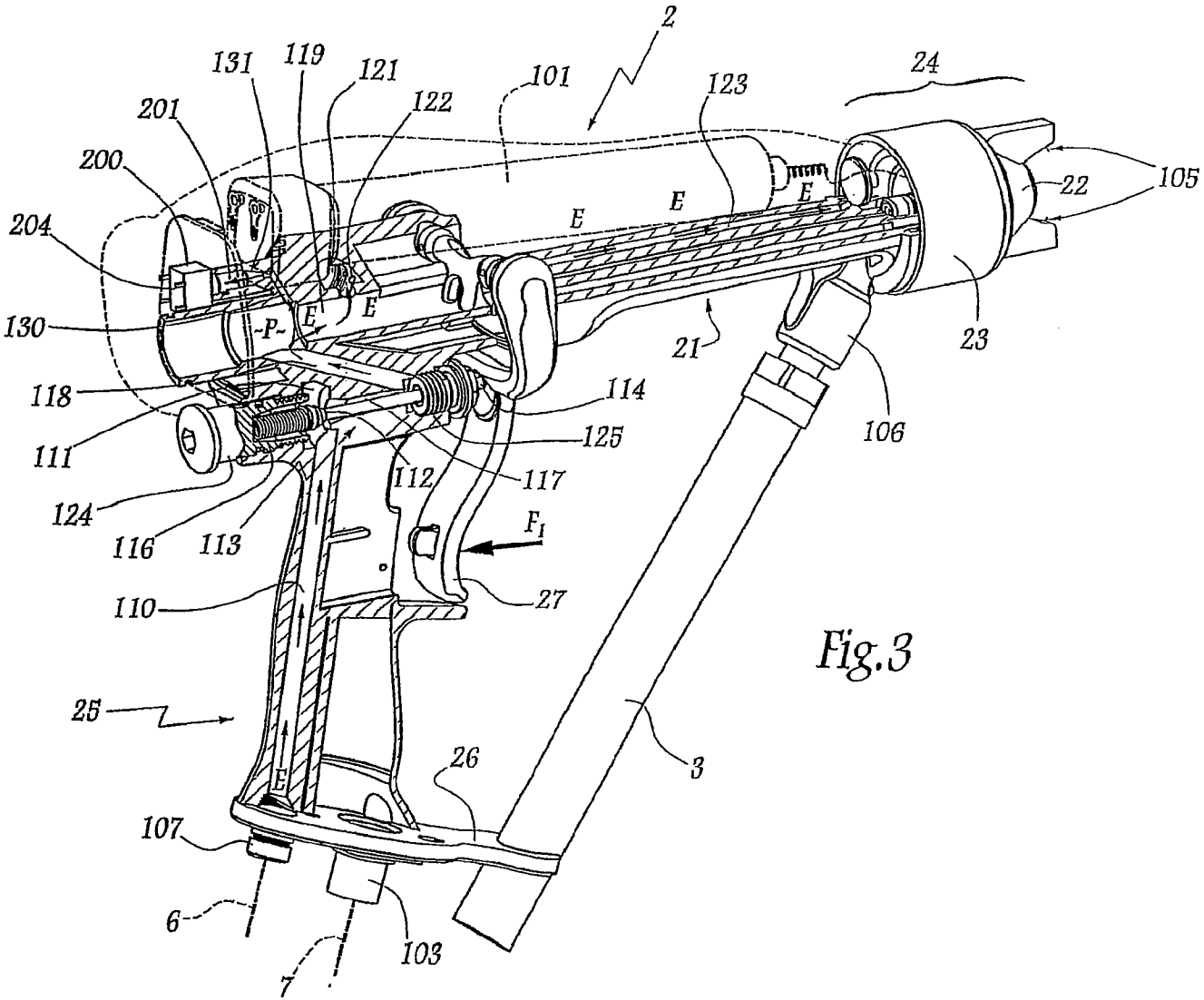
FIG. 3 is a perspective view from another angle showing the elements shown in continuous lines in FIG. 2, the trigger of the sprayer being actuated.

Downstream from the pointer 112, a duct 117 extends around the rod 114 and opens out into another duct 118 providing a connection with a chamber 119 that is formed in line with the barrel 21 and that communicates via a lateral opening 120 with an auxiliary chamber 121 from which there extends a duct 122 that goes as far as the spray head 24, its extent being embodied by a groove 123 in FIGS. 2 and 3, it being understood that in practice this groove is closed (upwardly in the figures) by an element of the spray gun that is not shown.

The chamber 119 is also connected by a duct 130 to an auxiliary chamber 131 in which there is mounted the detection portion 201 of a relative pressure sensor 200. Given that the chambers 119 and 131 are in communication, the sensor 200 is suitable for detecting the pressure of the atomization air in the chamber 119, i.e. in the circuit feeding the head 24, downstream from the valve 113.

The sensor 200 may be of any type adapted to its function, and in particular it may be a piezoelectric, capacitive, or resistive sensor.

The pressure P downstream from the valve 113 varies depending on whether the valve is closed or open. When the valve 113 is closed, i.e. when the needle 112 is resting against the seat 115, the pressure P in the chamber 119 is substantially equal to atmospheric pressure, as can be detected by the sensor 200.

When the operator acts on the trigger 27 and exerts a force represented by arrow $F_1$ in FIG. 3, the needle 112 is lifted off its seat 115 and a flow of atomization air takes place via the following ducts and chambers 110, 114, 117, 118, 119, 120, 121, 122, and 123, as far as the head 24, as represented by arrow E. The flow of atomization air increases the pressure P in the chamber 119 by an amount of the order of several bars, which is immediately detected by the portion 201 of the sensor 200 in the chamber 131, since the pressure in said chamber can be considered as being equal to the pressure P. In practice, the detection threshold of the portion 201 is set at about 300 millibars (mbar). It could be set at some other value, e.g. 50 mbar, 100 mbar, or 200 mbar.

When the operator releases the trigger 27, the supply of atomization air to the chamber 119 is interrupted and the pressure in said chamber returns quickly to be substantially equal to atmospheric pressure, as likewise detected by the sensor 200.

The sensor 200 is connected to an electronic circuit card 202, itself connected to the cable 102 by a conductor wire 203. The sensor is supplied with electricity from the module 5 via the elements 7, 102, 203, and 202. The card 202 is not essential, and the sensor 200 could be connected directly to the module 5.

It is thus possible to send a signal $S_1$ to the module 5, via the cables 203, 102, and 7, which signal $S_1$ is representative of the value of the pressure P detected by the sensor 200 when the valve 113 is opened or closed.

A logic unit 51 integrated in the module 5 serves to process the signal $S_1$ to control the electricity supplied to the spray gun 2 as a function of pre-established characteristic curves. More precisely, the logic unit 51 ensures that electricity is injected into the cable 7 only when the value of the pressure P as detected by the sensor 200 and as transmitted in the form of a signal $S_1$, is greater than a predetermined value that corresponds to the valve 113 being open, i.e. to the fact that the trigger 27 is being actuated by the operator.

A display 52 is provided on the front face of the module 5 and enables the operator to know the value of the pressure P of the atomization gas in the sprayer 2, which can be useful in setting the operating parameters of the sprayer. In addition, in an aspect of the invention that is not shown, the chamber 119 may open out towards the rear of the sprayer 2 and may be fitted with a setting element that enables a variable head loss to be to be established in the chamber 119, thus also enabling the operator to adjust the pressure P at which atomization air is fed to the head 24.

The fact that the pressure detected by the sensor 200 is displayed on the module 5 makes it easy for the operator to be informed about the pressure, and this is found to be much more practical than using a system in which a pressure indicator is mounted on the spray gun, since it is common practice for painters to cover their spray guns in a protective cover, or in stretch film, which makes it impossible to read a display provided on a spray gun.

The supplies to the elements 101 and 200 and the transfer of information relating to the signal $S_1$ take place via distinct conductors making up the cables 7, 102, and 203.

In a variant, a multiplexing technique could also be used for transmitting the signal $S_1$ via the cables 7 and 102 that form the line supplying electricity to the cascade 101.

In a variant of the invention that is not shown, the signal $S_1$ may be transmitted from the sensor 200 or the card 202 by means of a wireless transmitter, of the ultrasound or infrared type, with an appropriate receiver then being provided on the power supply module 5.

In order to avoid the value of the pressure measured by the sensor 200 drifting, the logic unit 51 is provided with calculation means serving to detect a rapid drop in the pressure P, corresponding to the trigger being released. It is then possible, immediately after each occasion the trigger is closed, to calibrate the measurement from the sensor 200 by taking account of the real value of atmospheric pressure. To do this, the value of the signal $S_1$ issued by the sensor 200 when measuring atmospheric pressure is stored in memory by the unit 51 and is then subtracted from the value of the signal $S_1$ issued by the sensor 200 when the trigger is actuated. This thus serves to reinitialize the sensor 200 on each occasion that the trigger is released. Such an approach makes it possible to be unaffected by drift in the values detected by the sensor 200 due to the effect of variations in ambient temperature or in the temperature of the atomization air. The operations of performing calibration and of subtracting the value corresponding to atmospheric pressure are performed in the logic unit 51 where the signal $S_1$ coming from the sensor 200 is processed.

The sensor 200 is provided with a pressure intake 204 situated on its rear face opposite from its portion 201 and serving to detect the pressure inside the body 28 in a zone that lies outside the ducts and chambers in which atomization air flows. This pressure is normally equal to atmospheric pressure, providing the ducts for passing the flow E of atomization air are well isolated from the outside.

This pressure intake 204 enables the sensor 200 to supply a signal $S_1$ that is representative of the relative pressure in the chamber 131.

The sensor 200 also serves to detect an internal leak from the spray gun 2 when the trigger 27 is released. When the trigger is released, the pressure in the duct for passing the atomization air flow decreases rapidly, as does the pressure in the chamber 131, until atmospheric pressure is reached. If there is a leak inside the spray gun, then the pressure inside the body 28, which pressure is detected via the intake 204, increases progressively, to such an extent that the relative pressure detected by the sensor 200 then becomes negative, which is an indication of an anomaly.

In practice, the pressure value detected by the sensor 200 on each release of the trigger 27 is compared with a minimum value $P_{min}$. If the detected pressure value P is greater than $P_{min}$, then the unit 51 proceeds with recalibrating the sensor so that the value of P is considered to be equal to zero by the unit 51. If the measured pressure is less than $P_{min}$, then an alarm signal is issued by the module 5 so as to inform the operator that there is a leak inside the spray gun 2.

It should be observed that even if the value of the pressure in the chamber 131 is not identical to the value of the pressure in the chamber 119, the value detected by the sensor 200 is representative of the value of the pressure at which atomization air is fed to the head 24.

The invention is described above in the context of its use in a hand-held sprayer. It is nevertheless applicable to an automatic sprayer, in which case the valve is remotely controlled. The invention is applicable to a sprayer for spraying a coating material that is in liquid or power form.

The invention claimed is:

1. An installation for electrostatically spraying a coating material, the installation comprising a sprayer provided with voltage-multiplier means suitable for generating a direct high voltage for electrostatically charging said material, said sprayer being fitted with a controlled valve controlling the flow of atomization air inside said sprayer towards a spray head, wherein a pressure sensor integrated in said sprayer is suitable for detecting a value representative of the pressure of atomization air downstream from said valve and for delivering a signal suitable for use in controlling the supply of electricity to said voltage-multiplier means.

2. An installation according to claim 1, wherein the installation also comprises a power supply module, distinct from said sprayer, for supplying electricity to said voltage-multiplier means, and wherein said signal is transmitted to said module that controls the supply of electricity to said voltage-multiplier means as a function of said signal.

3. An installation according to claim 2, wherein said power supply module is provided with a display for displaying the value of the pressure detected by said sensor.

4. An installation according to claim 2 wherein said signal is transmitted to said module via the a line for supplying electricity to said voltage-multiplier means from said module.

5. An installation according to claim 2 wherein said signal is sent to said module by a wireless connection.

6. An installation according to claim 1, wherein a logic unit is configured to receive said signal issued by said sensor and correct drift of said sensor relative to atmospheric pressure.

7. An installation according to claim 1, wherein said sprayer is hand-held and said valve is controlled by a trigger designed to be actuated by an operator.

8. An installation according to claim 1, wherein said sensor is suitable for detecting an abnormal rise in pressure inside said sprayer away from a path along which the atomization air flows, and for delivering a corresponding signal to a processor means.

9. A method of controlling the supplying of electricity to voltage-multiplier means belonging to an electrostatic sprayer for spraying a coating material and suitable for generating a direct high voltage for electrostatically charging said material, wherein the method comprises the steps consisting in:

a) detecting, downstream from a controlled valve for controlling the flow of atomization air inside said sprayer, a value that is representative of the pressure of the atomization air; and b) controlling the supply of electricity to said voltage-multiplier means as a function, in particular, of a signal representative of the value that is detected.

10. A method according to claim 9, characterized in that said voltage-multiplier means are supplied with electricity from a module that is distinct from said sprayer, and in that said signal is supplied to said module.

11. A method according to claim 9, wherein after each closure of said valve, a sensor used for detecting the pressure is reinitialized by taking account of the signal at atmospheric pressure.

12. A method according to claim 9, wherein after each closure of said valve, a sensor used for detecting the pressure, is used for detecting any possible leak inside said sprayer.

* * * * *